US005997350A

United States Patent [19]

Burris et al.

[11] Patent Number: 5,997,350

[45] Date of Patent: Dec. 7, 1999

[54] F-CONNECTOR WITH DEFORMABLE BODY AND COMPRESSION RING

[75] Inventors: Donald A. Burris, Peoria; Herman P. Durst, Chandler, both of Ariz.

[73] Assignee: Gilbert Engineering Co., Inc., Glendale, Ariz.

[21] Appl. No.: 09/093,274

[22] Filed: Jun. 8, 1998

[51] Int. Cl.[6] ..... H01R 9/05

[52] U.S. Cl. ..... 439/585; 439/578

[58] Field of Search ..... 439/578, 585, 439/587, 589, 584, 583, 475

[56] References Cited

U.S. PATENT DOCUMENTS

| | | | |
|---|---|---|---|
| 3,184,706 | 5/1965 | Atkins | 339/177 |
| 4,156,554 | 5/1979 | Aujla | 339/177 |
| 4,354,721 | 10/1982 | Luzzi | 439/475 |
| 4,400,050 | 8/1983 | Hayward | 339/177 |
| 4,575,274 | 3/1986 | Hayward | 403/2 |
| 4,583,811 | 4/1986 | McMills | 339/177 |
| 4,676,577 | 6/1987 | Szegda | 439/584 |
| 4,755,152 | 7/1988 | Elliot et al. | 439/452 |
| 4,834,675 | 5/1989 | Samchisen | 439/578 |
| 4,990,106 | 2/1991 | Szegda | 439/585 |
| 5,338,225 | 8/1994 | Jacobsen et al. | 439/585 |
| 5,470,257 | 11/1995 | Szegda | 439/578 |
| 5,586,910 | 12/1996 | Del Negro et al. | 439/584 |
| 5,863,220 | 1/1999 | Holliday | 439/584 |

FOREIGN PATENT DOCUMENTS 0 265 276 4/1988 European Pat. Off. .

*Primary Examiner*—Michael L. Gellner
*Assistant Examiner*—Antoine Ngandjui
*Attorney, Agent, or Firm*—Cahill, Sutton & Thomas, P.L.C.

[57] ABSTRACT

A compression type coaxial cable F-connector includes a conventional coupling nut and tubular post. A cylindrical body member is secured to the tubular post and includes a sleeve for receiving the jacket of the coaxial cable. A circular relief in the sleeve allows the end of such sleeve to be deformed inwardly toward the cable jacket. A compression ring is mounted over the outer wall of the sleeve of the cylindrical body member and includes a tapered inner bore which forces the end of the sleeve inwardly against the cable jacket as the compression ring is advanced axially over the cylindrical body member. As the end of the sleeve is deformed inwardly, it extends just behind a circular barb formed about the tubular post to pinch the cable jacket therebetween. The compression ring can be manufactured as a separate component, or the compression ring can initially be integral with the sleeve of the cylindrical body member and attached thereto by a frangible connection.

7 Claims, 2 Drawing Sheets

F-CONNECTOR WITH DEFORMABLE BODY AND COMPRESSION RING

BACKGROUND OF THE INVENTION

1. Field of the Invention

The present invention relates generally to so-called F-connectors used primarily in the cable television industry to connect coaxial cables to threaded ports, and more particularly to such F-connectors that are installed using an axial compression tool.

2. Description of the Related Art

Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath); the conductive grounding sheath is itself surrounded by a protective outer jacket. The F-connector is secured over the prepared end of the jacketed coaxial cable, allowing the end of the coaxial cable to be threadedly connected with a threaded port of a terminal block.

Crimp style F-connectors are known wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable. Examples of such crimp connectors are disclosed within U.S. Pat. No. 4,400,050 to Hayward, assigned to Gilbert Engineering Co., Inc.; and U.S. Pat. No. 4,990,106 to Szegda, assigned to John Mezzalingua Assoc. Inc.

It is known in the art that the passage of moisture between the coaxial cable jacket and the surrounding F-connector can lead to corrosion, increased contact resistance, reduced signal strength, and excessive RF leakage from the connector. Those skilled in the art have made various efforts to form a seal between the F-connector and the jacket of the coaxial cable to preclude such moisture ingress. F-connectors are known in the cable television industry wherein special sealing compounds are included in an effort to form leak-proof seals. For example, U.S. Pat. No. 4,755,152 to Elliot, et al., and assigned to Tele-Communications, Inc. discloses a crimp connector incorporating a glob of a gel or other movable sealing material within a cavity of the connector to form a seal between the jacket of the coaxial cable and the interior of the F-connector.

Still another form of F-connector is known wherein an annular compression sleeve is used to secure the F-connector over the prepared end of the cable. Rather than crimping a crimp sleeve radially toward the jacket of the coaxial cable, these F-connectors employ a plastic annular compression sleeve that is initially attached to the F-connector, but which is detached therefrom prior to installation of the F-connector. The compression sleeve includes an inner bore for following such compression sleeve to be passed over the end of the coaxial cable prior to installation of the F-connector. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen and assigned to LRC Electronics, Inc.; such patent discloses a compression sleeve type F-connector known in the industry as "Snap-n-Seal". A number of commercial tool manufacturers provide compression tools for axially compressing the compression sleeve into such connectors; for example, the CablePrep division of Ben Hughes Communication Products Company of Chester, Conn. sells such a hand-operated compression tool under the commercial designation "Terminx".

The aforementioned "Snap-n-Seal" compression connector requires substantial manipulation by an installer. The installer must detach the annular compression sleeve from the connector, slide the compression sleeve over the end of the coaxial cable, then install the connector, and finally compress the compression sleeve into the body of the connector. During assembly, the compression sleeve can easily become lost. In addition, such "Snap-n-Seal" connectors are significantly more expensive than conventional crimp style connectors.

A somewhat related radial compression-type F-connector is disclosed within U.S. Pat. No. 5,470,257 to Szegda. A tubular locking member protrudes axially into the open rear end of the outer collar or sleeve. The tubular locking member is displaceable axially within the outer collar between an open position accommodating insertion of the tubular post into the prepared end of the coaxial cable, and a clamped position fixing the end of the cable within the F-connector. An O-ring is mounted on the rear end of the tubular locking member to seal the connection between the tubular locking member and the outer collar as the tubular locking member is axially compressed. Such connectors have been sold in the past under the designation "CMP". The O-ring provided on the tubular locking member is exposed and unprotected prior to axial compression of the F-connector.

It is known in the coaxial cable field generally that collars or sleeves within a coaxial cable connector can be compressed inwardly against the outer surface of a coaxial cable to secure a coaxial cable connector thereto. For example, in U.S. Pat. No. 4,575,274 to Hayward and assigned to Gilbert Engineering Company Inc., a connector assembly for a signal transmission system is disclosed wherein a body portion threadedly engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. However, the connector shown in the Hayward '274 patent is much more expensive than conventional F-connectors and can not be installed quickly, as by a simple crimp or compression tool; rather, the mating threads of such connector must be tightened, as by using a pair of wrenches.

Accordingly, it is an object of the present invention to provide a simple and inexpensive F-connector that can easily be machined from a small number of components, and which can be quickly installed over the prepared end of a coaxial cable using a conventional F-connector axial compression installation tool.

It is another object of the present invention to provide such an F-connector that does not require any threaded, rotational movement of the connector components during installation in order to secure such connector over the end of the coaxial cable.

It is still another object of the present invention to provide such an F-connector which forms a reliable moisture proof sea l between the F-connector and the jacket of the coaxial cable to preclude moisture from passing between the F-connector and the jacket of the coaxial cable extending therein, while avoiding the need for gels or other sealing compounds.

A further object of the present invention to provide such an F-connector that is shipped to a user as a one-piece structure, and which is installed onto the end of a coaxial cable as a one piece structure without detachment of any components, in order to simplify the installation of such connector over the end of a coaxial cable, and to avoid the loss of detachable components.

Still another object of the present invention is to provide such an F-connector which avoids the need for the assembly of any O-rings for the purpose of creating a seal between the connector and the jacket of the cable.

A further object of the present invention is to increase the pull-out strength of the F-connector/coaxial cable assembly by making it more difficult to dislodge the cable jacket from the F-connector following installation.

These and other objects of the present invention will become more apparent to those skilled in the art as the description of the present invention proceeds.

SUMMARY OF THE INVENTION

Briefly described, and in accordance with the preferred embodiments thereof, the present invention relates to a coaxial cable F-connector for coupling the end of a coaxial cable to a threaded port. The F-connector of the present invention includes a tubular post having a first end adapted to be inserted into an exposed, prepared end of the coaxial cable. This first end of the tubular post extends around the dielectric of the coaxial cable but passes under the conductive grounding sheath and jacket thereof. The tubular post includes a second opposing end.

The F-connector of the present invention further includes a nut having a first end for rotatably engaging the second end of the tubular post and having an opposing second end with an internally threaded bore for threadedly engaging a threaded port; this nut serves to secure the F-connector to a threaded port.

The F-connector of the present invention also includes a cylindrical body member having first end and second opposing ends. The first end of the cylindrical body member includes a cylindrical sleeve having an outer wall and an inner wall, the inner wall bounding a first central bore for encircling the tubular post and for receiving the outer jacket of the coaxial cable. The second end of the cylindrical body member engages the tubular post near the second end thereof. The cylindrical sleeve has an open rear end portion into which the prepared end of the coaxial cable is inserted; the open rear end portion of such cylindrical sleeve is deformable.

Finally, the F-connector of the present invention includes a compression ring having a central passageway extending therethrough between first and second opposing ends thereof. The first end of the compression ring has a first internal bore of a diameter commensurate with the diameter of the outer wall of the cylindrical sleeve to form a friction fit therebetween while allowing the first end of said compression ring to extend over the first end of the cylindrical body member. The first internal bore of the compression ring forms part of the central passageway of the compression ring and leads to an inwardly tapered annular wall which further reduces the internal diameter of the central passageway. This inwardly tapered annular wall causes the rear end portion of the cylindrical sleeve to be deformed inwardly toward the tubular post and against the cable jacket as the compression ring is advanced axially over the cylindrical body member toward the second end of said cylindrical body member.

In the preferred embodiment of the present invention, the cylindrical sleeve is made of metal, and includes a circular relief, or weakened area, formed upon the rear end portion thereof to facilitate bending of the rear end portion of the cylindrical sleeve as the compression ring is axially advanced thereover. In addition, the tubular post preferably includes an a circular barb extending about its outer surface proximate the first end thereof; the rear end portion of the cylindrical sleeve extending axially to a point proximate such circular barb, whereby deformation of the rear end portion of the cylindrical sleeve inwardly toward the tubular post caused by the advancement of the compression ring results in the cable jacket being pinched along a serpentine path between the end of the cylindrical sleeve and the circular barb to securely fasten the F-connector to the cable jacket.

The F-connector of the present invention is preferably supplied with the compression ring pre-mounted over a portion of the first end of the cylindrical body member; however, as initially supplied, the compression ring is not fully axially advanced over the first end of the cylindrical body member in order to permit the installation of the connector onto the prepared end of a coaxial cable.

In one embodiment of the present invention, the compression ring is manufactured as a separate component from the cylindrical body member. In an alternate embodiment of the present invention, the compression ring is initially integral with the open rear end of the cylindrical sleeve of the cylindrical body member and connected thereto by a frangible connection. In this alternate embodiment, after the connector is installed over the prepared end of a coaxial cable, the connector is compressed by an axial compression tool, and the axial advancement of the compression ring toward the second end of the cylindrical body member breaks the frangible connection between the compression ring and the open rear end of the cylindrical sleeve.

In the preferred form of the present invention, the cylindrical body member of the F-connector includes an enlarged diameter shoulder generally between the first and second ends thereof. The enlarged diameter shoulder has a diameter larger than the outer diameter of the cylindrical sleeve and serves as a stop to prevent excessive compression of the compression ring. When the compression ring has been sufficiently axially compressed by an axial compression tool, the first end of the compression ring engages, and is stopped by, the enlarged diameter shoulder. If desired, one or more circular grooves can be formed in the outer wall of the cylindrical sleeve to reduce drag as the compression ring is axially advanced over the cylindrical sleeve.

DETAILED DESCRIPTION OF THE PREFERRED EMBODIMENT

Figure 1:
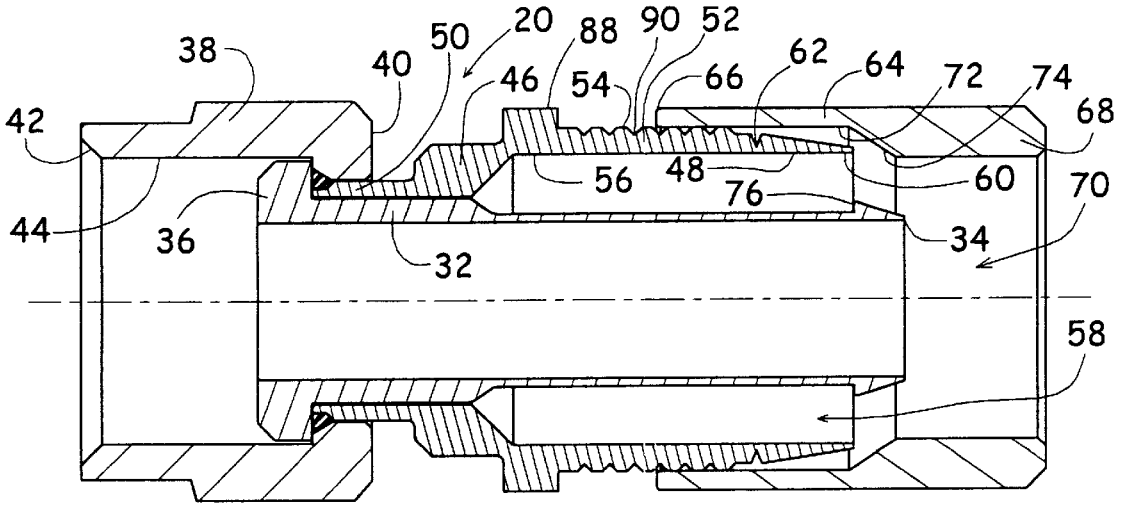
FIG. 1 is a cross-sectional view of an F-connector fitting constructed in accordance with the present invention.
Figure 2:
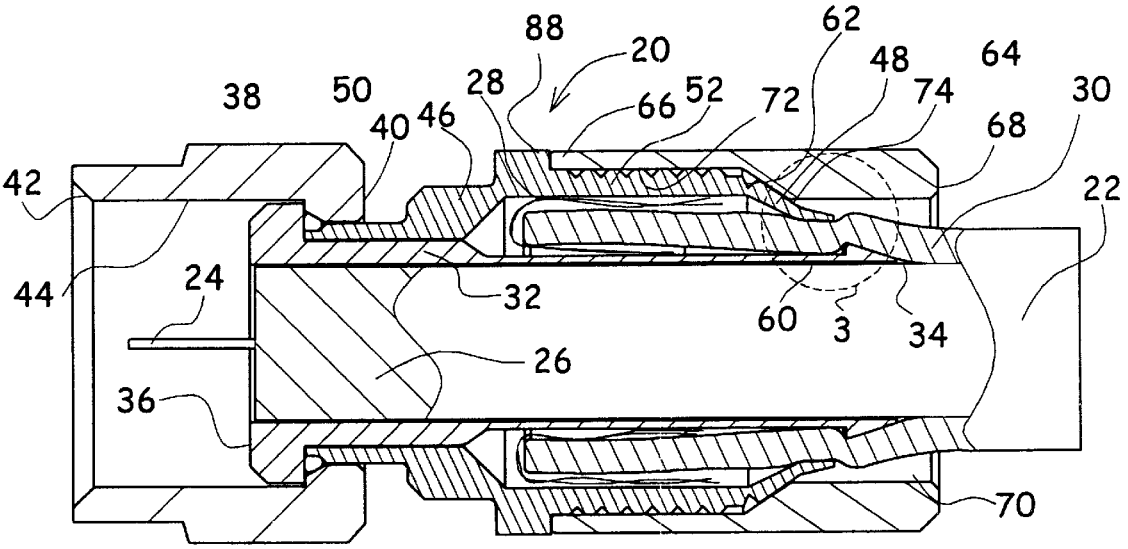
FIG. 2 is a cross-sectional view of the F-connector fitting shown in FIG. 1 after being installed over the prepared end of a coaxial cable and being axially compressed by an axial compression tool.

FIG. 1 illustrates in cross-section an F-connector constructed in accordance with a preferred embodiment of the present invention and is designated generally by reference numeral 20. F-connector 20 can be used to couple the end of a coaxial cable to a threaded port (not shown). Referring briefly to FIG. 2, coaxial cable 22 has a center conductor 24 surrounded by a dielectric layer 26; in turn, dielectric layer is surrounded by a conductive grounding sheath 28 covered by a protective outer cable jacket 30.

F-connector 20 of FIG. 1 includes a tubular post 32 preferably made of metal and having a first end 34 adapted to be inserted into the exposed end of coaxial cable 22 around the dielectric 26 thereof and under the conductive grounding sheath 28. Tubular post 32 also has an opposing second end 36. F-connector 20 also includes a nut 38 having a first end 40 for rotatably engaging second end 36 of tubular post 32 and having an opposing second end 42 with an internally threaded bore 44 for threadedly engaging a threaded port (not shown).

F-connector 20 further includes a cylindrical body member 46 also made of metal and having a first end 48 and a second end 50. First end 48 of cylindrical body member 46 includes a cylindrical sleeve 52 having an outer wall 54 of a first predetermined diameter and an inner wall 56 bounding a first central bore 58 extending about tubular post 32. Second end 50 of cylindrical body member 46 is of a smaller diameter than first end 48 thereof, and engages tubular post 32 proximate its second end 36. Cylindrical sleeve 52 has an open rear end portion 60 for receiving the outer jacket 30 of coaxial cable 22; this rear end portion 60 is deformable. As shown in FIGS. 1 and 2, cylindrical sleeve 52 has a circular relief, or weakened area 62, formed therein as by cutting a circular groove thereabout, to facilitate bending of cylindrical sleeve 52 at such point.

Figure 3:
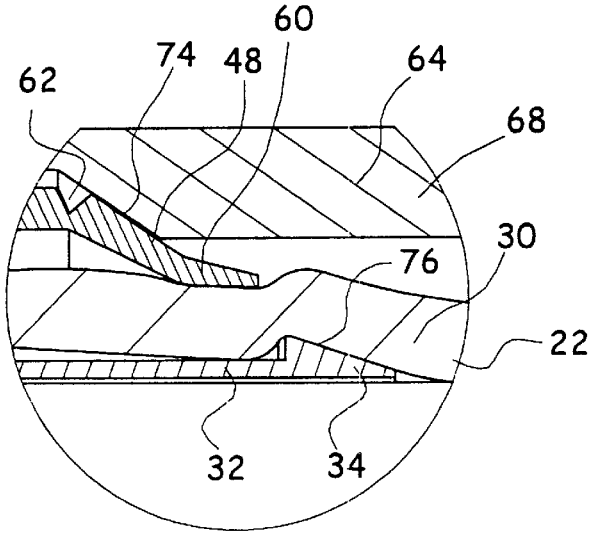
FIG. 3 is an enlarged view of the deformable portion of the F-connector after being deformed against the cable jacket and tubular post.

Still referring to FIGS. 1 and 2, F-connector 20 also includes a compression ring 64 having a first end 66 and an opposing second end 68. Compression ring 64 is also preferably made of metal. A central passageway 70 extends through compression ring 64 between first end 66 and second end 68. A portion of central passageway 70 is formed by a first internal bore 72 communicating with the first end 66 of compression ring 64. First internal bore 72 has a diameter commensurate with the outer diameter of outer wall 54 of cylindrical sleeve 52 for allowing first end 66 of compression ring 64 to extend over first end 48 of cylindrical body member 46. Central passageway 70 of compression ring 64 also includes an inwardly tapered annular wall 74 leading from first internal bore 72 and narrowing to a reduced diameter as compared with the internal diameter of first internal bore 72. This inwardly tapered annular wall 74 causes the rear end portion 60 of cylindrical sleeve 52 to be deformed inwardly toward tubular post 32 and against cable jacket 30, as shown in FIGS. 2 and 3, as compression ring 64 is advanced axially over cylindrical body member 46 toward the second end 50 thereof.

In order to maximize retention strength of the cable jacket within F-connector 20, tubular post 32 has a circular barb 76 formed thereabout proximate its first end 34. Cylindrical sleeve 52 initially extends axially to a point proximate circular barb 76. During axial compression of F-connector 20, inward deformation of the rear end portion 60 of cylindrical sleeve 52 caused by the advancement of compression ring 64, and hence tapered annular wall 74, results in rear end portion 60 being flattened just behind barb 76; cable jacket 30 is thereby pinched between deformed rear end 60 of cylindrical sleeve 52 and barb 76 in a serpentine path to increase the pull-out force required to dislodge cable 22 from F-connector 20.

Figure 4:
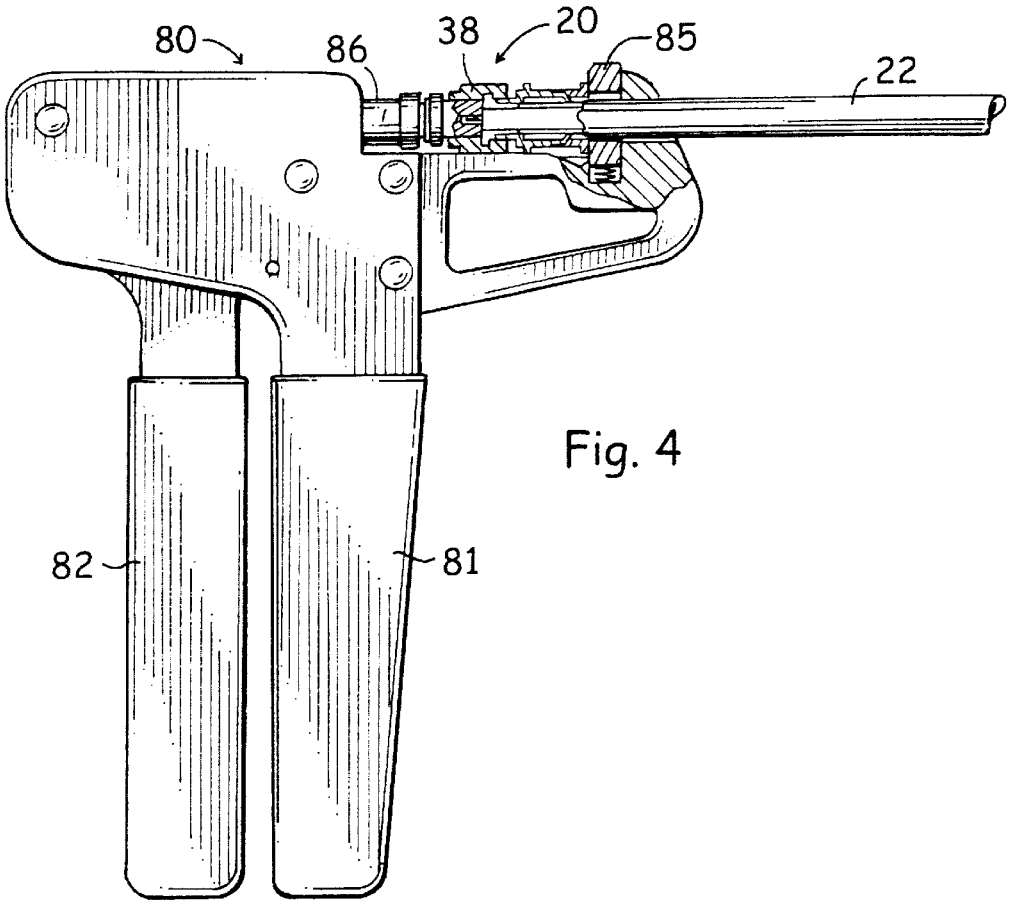
FIG. 4 is a partial sectional view of an axial compression tool being used to axially compress the F-connector shown in FIG. 1.

As initially supplied to a customer, F-connector 20, in a first embodiment, is mounted over first end 48 of cylindrical body member 46, but is not fully axially advanced, as shown in FIG. 1. This allows a cable technician to install F-connector 20 over the prepared end of cable 22. In FIG. 4, a pistol grip compression tool 80 is shown while being used to secure F-connector 20 onto the prepared end of a coaxial cable 22. Compression tool 80 may be of the type commercially available from the CablePrep division of Ben Hughes Communication Products Company of Chester, Conn., under the commercial designation "Terminx". Compression tool 80 includes a pair of levers or handles 81 and 82, as well as a spring-loaded connector yoke 85 for releasably holding connector 20 and cable 22 in place during compression of connector 20. Compression tool 80 also includes a movable ram 86 that is adapted to extend within nut 38 of F-connector 20, while allowing the bared center conductor (24) of coaxial cable 22 to extend herein without interference. Movable ram 86 is forced toward connector yoke 85 when handle grips 81 and 82 are squeezed together by the user, thereby compressing together the components of F-connector 20 captured therebetween.

To avoid over-compression of F-connector 20, cylindrical body member 46 includes an enlarged diameter shoulder 88 located generally between first end 48 and second end 50 thereof Enlarged diameter shoulder 88 has a diameter larger than the diameter of outer wall 54 of cylindrical sleeve 52. As compression ring 64 advances axially along cylindrical sleeve 52, first end 66 of compression ring 64 eventually engages, and is stopped by, enlarged diameter shoulder 88 when compression ring 64 has been fully axially advanced over cylindrical sleeve 52.

First internal bore 72 of compression ring 64 engages outer wall 54 of cylindrical sleeve 52 with a friction fit. If such friction fit is too tight, it may be difficult to axially compress F-connector 20. In this event, one or more circular grooves 90, as shown in FIG. 1, may be formed in outer wall 54 to reduce the amount of friction between compression ring 64 and cylindrical sleeve 52.

Figure 5:
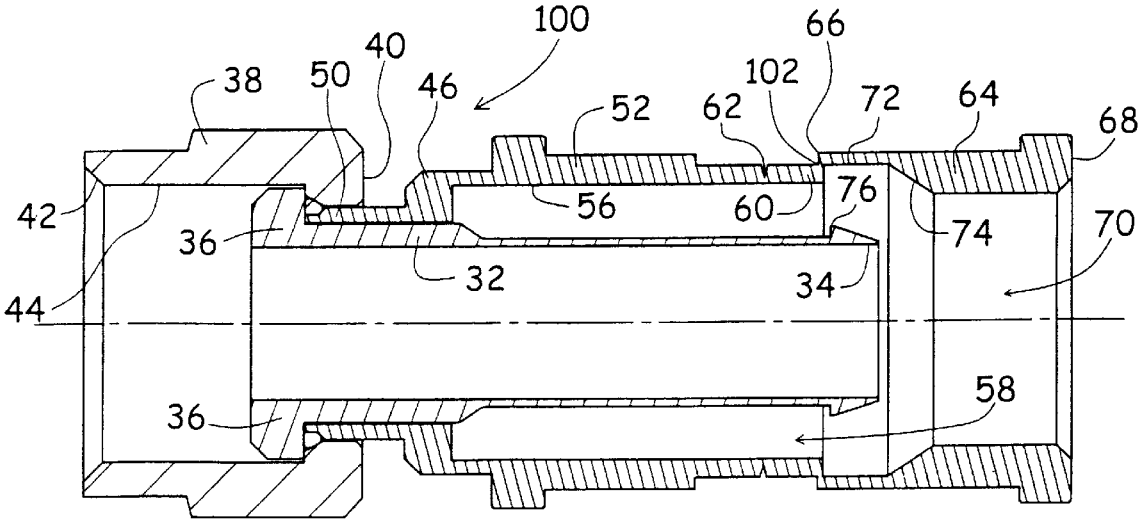
FIG. 5 is a cross-sectional drawing of an alternate embodiment of the F-connector shown in FIG. 1 wherein the compression ring is initially integral with the cylindrical body of the F-connector.

Referring to FIG. 5, an alternate embodiment of the present invention is illustrated wherein components similar to those already described above in regard to FIGS. 1 and 2 have been referenced by like reference numerals. F-connector 100 of FIG. 5 is similar to F-connector 20 of FIG. 1, except that compression ring 64 is initially integral with cylindrical sleeve 52 of cylindrical body member 46. In this embodiment, cylindrical sleeve 52 and compression ring 64 are machined at the same time from the same stock material. Compression ring 64 is connected to rear end 60 of cylindrical sleeve 52 by a frangible connection 102. F-connector 100 can be shipped to end users before such frangible connection is broken. F-connector 100 is installed onto the prepared end of a coaxial cable in the same manner described above. As the user begins to axially compress connector 100, frangible connection 102 is broken, compression ring 64 is then separated from cylindrical sleeve 52, and compression ring 64 simultaneously advances axially over cylindrical sleeve 52 to deform rear end 60 thereof in the same manner already described.

Those skilled in the art will now appreciate that an improved F-connector has been described for connecting a coaxial cable to a threaded port. The described connector is of simple and inexpensive construction, and is easily machined from a small number of components. F-connector 20 can be quickly installed over the prepared end of a coaxial cable using a conventional F-connector axial compression installation tool. The deformable rear end 60 of cylindrical sleeve 52, in conjunction with barb 76 of tubular post 32, forms a moisture proof seal between cylindrical sleeve 52 and cable jacket 30 without the need for any O-rings, and exhibits a relatively high mechanical retention strength. Because compression ring 64 comes already mounted on cylindrical sleeve 52, installation is simplified, and no detachable components can be lost. While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A connector for coupling the end of a coaxial cable to a threaded port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an exposed end of the coaxial cable around the dielectric thereof and under the conductive grounding sheath thereof, said tubular post having an opposing second end;

b. a nut having a first end for rotatably engaging the second end of said tubular post and having an opposing second end with an internally threaded bore for threadedly engaging a threaded port;

c. a cylindrical body member having a first end and a second end, the first end of said cylindrical body member including a cylindrical sleeve having an outer wall of a first predetermined diameter and an inner wall, the inner wall bounding a first central bore extending about said tubular post, the second end of said cylindrical body member engaging said tubular post proximate the second end thereof, said cylindrical sleeve having an open rear end portion for receiving the outer jacket of the coaxial cable, said open rear end portion being deformable; and d. a compression ring having first and second opposing ends and having a central passageway extending therethrough between the first and second ends thereof, the first end of said compression ring having a first internal bore of a diameter commensurate with the first predetermined diameter of the outer wall of said cylindrical sleeve for allowing the first end of said compression ring to extend over the first end of said cylindrical body member, the central passageway of said compression ring including an inwardly tapered annular wall leading from the first internal bore and narrowing to a reduced diameter as compared with the first predetermined diameter;

e. said inwardly tapered annular wall causing said rear end portion of said cylindrical sleeve to be deformed inwardly toward said tubular post and against the jacket of the coaxial cable as said compression ring is advanced axially over the cylindrical body member toward the second end of said cylindrical body member.

2. The connector recited by claim 1 wherein said tubular post includes an outer surface, and wherein the outer surface of said tubular post has a circular barb formed thereabout proximate the first end thereof, the sleeve of said cylindrical body member extending axially to a point proximate said circular barb, whereby deformation of the sleeve inwardly toward the tubular post caused by the advancement of said compression ring results in the cable jacket being pinched between the end of the sleeve of said cylindrical body member and the circular barb formed upon said tubular post.

3. The connector recited by claim 1 wherein said compression ring is mounted over the first end of said cylindrical body, but is not fully axially advanced, prior to installation over the end of a coaxial cable.

4. The connector recited by claim 1 wherein said compression ring is initially integral with the sleeve of said cylindrical body member and connected thereto by a frangible connection, and wherein axial advancement of said compression ring toward the second end of said cylindrical body member breaks the frangible connection between said compression ring and said cylindrical body member.

5. The connector recited by claim 1 wherein said cylindrical body member includes an enlarged diameter shoulder generally between the first and second ends thereof, said enlarged diameter shoulder having a diameter larger than the first predetermined diameter of the outer wall of said cylindrical sleeve, the first end of said compression ring engaging, and being stopped by, said enlarged diameter shoulder when said compression ring has been fully axially advanced over said cylindrical sleeve.

6. A connector for coupling the and of a coaxial cable to a threaded port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an exposed end of the coaxial cable around the dielectric thereof and under the conductive grounding sheath thereof, said tubular post having an opposing second end;

b. a nut having a first end for rotatably engaging the second end of said tubular post and having an opposing second end with an internally threaded bore for threadedly engaging a threaded port;

c. a cylindrical body member having a first end and a second end, the first end of said cylindrical body member including a cylindrical sleeve having an outer wall of a first predetermined diameter and an inner wall, the inner wall bounding a first central bore extending about said tubular post, the second end of said cylindrical body member engaging said tubular post proximate the second end thereof, said cylindrical sleeve having an open rear end portion for receiving the outer jacket of the coaxial cable, said open rear end portion being deformable; and d. a compression ring having first and second opposing ends and having a central passageway extending therethrough between the first and second ends thereof, the first end of said compression ring having a first internal bore of a diameter commensurate with the first predetermined diameter of the outer wall of said cylindrical sleeve for allowing the first end of said compression ring to extend over the first end of said cylindrical body member, the central passageway of said compression ring including an inwardly tapered annular wall leading from the first internal bore and narrowing to a reduced diameter as compared with the first predetermined diameter;

e. said inwardly tapered annular wall causing said rear end portion of said cylindrical sleeve to be deformed inwardly toward said tubular post and against the jacket of the coaxial cable as said compression ring is advanced axially over the cylindrical body member toward the second end of said cylindrical body member; and f. wherein said cylindrical sleeve of said cylindrical body member has a circular relief formed therein to facilitate bending of said cylindrical sleeve as said compression ring is axially advanced thereover.

7. A connector for coupling the end of a coaxial cable to a threaded port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an exposed end of the coaxial cable around the dielectric thereof and under the conductive grounding sheath thereof, said tubular post having an opposing second end;

b. a nut having a first end for rotatably engaging the second end of said tubular post and having an opposing second end with an internally threaded bore for threadedly engaging a threaded port;

c. a cylindrical body member having a first end and a second end, the first end of said cylindrical body member including a cylindrical sleeve having an outer wall of a first predetermined diameter and an inner wall, the inner wall bounding a first central bore extending about said tubular post, the second end of said cylindrical body member engaging said tubular post proximate the second end thereof, said cylindrical sleeve having an open rear end portion for receiving the outer jacket of the coaxial cable, said open rear end portion being deformable; and d. a compression ring having first and second opposing ends and having a central passageway extending therethrough between the first and second ends thereof, the first end of said compression ring having a first internal bore of a diameter commensurate with the first predetermined diameter of the outer wall of said cylindrical sleeve for allowing the first end of said compression ring to extend over the first end of said cylindrical body member, the central passageway of said compression ring including an inwardly tapered annular wall leading from the first internal bore and narrowing to a reduced diameter as compared with the first predetermined diameter;

e. said inwardly tapered annular wall causing said rear end portion of said cylindrical sleeve to be deformed inwardly toward said tubular post and against the jacket of the coaxial cable as said compression ring is advanced axially over the cylindrical body member toward the second end of said cylindrical body member; and f. wherein a series of grooves are formed in the outer wall of said cylindrical sleeve to reduce drag as the compression ring is axially advanced over said cylindrical sleeve.

* * * * *

US005997350C1

(12) EX PARTE REEXAMINATION CERTIFICATE (5290th)

United States Patent

Burris et al.

(10) Number: US 5,997,350 C1

(45) Certificate Issued: Mar. 7, 2006

(54) F-CONNECTOR WITH DEFORMABLE BODY AND COMPRESSION RING

(75) Inventors: Donald A. Burris, Peoria, AZ (US); Herman P. Durst, Chandler, AZ (US)

(73) Assignee: Gilbert Engineering Co., Inc., Glendale, AZ (US)

Reexamination Request:
No. 90/006,791, Oct. 15, 2003

Reexamination Certificate for:

| | |
|---|---|
| Patent No.: | **5,997,350** |
| Issued: | **Dec. 7, 1999** |
| Appl. No.: | **09/093,274** |
| Filed: | **Jun. 8, 1998** |

(51) Int. Cl.
*H01R 9/05* (2006.01)

(52) U.S. Cl. ..... 439/585; 439/578

(58) Field of Classification Search ..... 439/578, 439/585, 587, 589, 584, 583, 475
See application file for complete search history.

(56) References Cited

U.S. PATENT DOCUMENTS

| | | | | |
|---|---|---|---|---|
| 3,184,706 | A | | 5/1965 | Atkins |
| 4,156,554 | A | | 5/1979 | Aujla |
| 4,354,721 | A | | 10/1982 | Luzzi |
| 4,400,050 | A | | 8/1983 | Hayward |
| 4,575,274 | A | | 3/1986 | Hayward |
| 4,583,811 | A | | 4/1986 | McMills |
| 4,668,043 | A | | 5/1987 | Saba et al. |
| 4,676,577 | A | | 6/1987 | Szegda |
| 4,755,152 | A | | 7/1988 | Elliot et al. |
| 4,834,675 | A | | 5/1989 | Samchisen |
| 4,990,106 | A | | 2/1991 | Szegda |
| 5,083,943 | A | | 1/1992 | Tarrant |
| 5,338,225 | A | | 8/1994 | Jacobsen et al. |
| 5,470,257 | A | | 11/1995 | Szegda |
| 5,586,910 | A | | 12/1996 | Del Negro et al. |
| 5,863,220 | A | | 1/1999 | Holliday |
| 6,153,830 | A | * | 11/2000 | Montena ..... 174/88 C |

FOREIGN PATENT DOCUMENTS

| | | |
|---|---|---|
| EP | 0 265 276 | 8/1993 |

* cited by examiner

*Primary Examiner*—Ross Gushi

(57) ABSTRACT

A compression type coaxial cable F-connector includes a conventional coupling nut and tubular post. A cylindrical body member is secured to the tubular post and includes a sleeve for receiving the jacket of the coaxial cable. A circular relief in the sleeve allows the end of such sleeve to be deformed inwardly toward the cable jacket. A compression ring is mounted over the outer wall of the sleeve of the cylindrical body member and includes a tapered inner bore which forces the end of the sleeve inwardly against the cable jacket as the compression ring is advanced axially over the cylindrical body member. As the end of the sleeve is deformed inwardly, it extends just behind a circular barb formed about the tubular post to pinch the cable jacket therebetween. The compression ring can be manufactured as a separate component, or the compression ring can initially be integral with the sleeve of the cylindrical body member and attached thereto by a frangible connection.

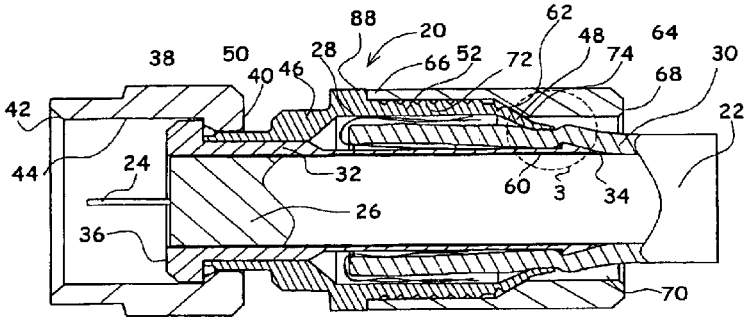

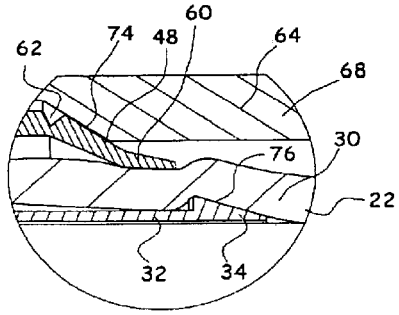

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 7 is confirmed.

Claim 4 is cancelled.

Claims 1 and 6 are determined to be patentable as amended.

Claims 2, 3 and 5, dependent on an amended claim, are determined to be patentable.

New claims 8, 9 and 10 are added determined to be patentable.

1. A connector for coupling the end of a coaxial cable to a threaded port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an exposed end of the coaxial cable around the dielectric thereof and under the conductive grounding sheath thereof, said tubular post having an opposing second end;

b. a nut having a first end for rotatably engaging the second end of said tubular post and having an opposing second end with an internally threaded bore for threadedly engaging [a] *the* threaded port;

c. a cylindrical body member having a first end and a second end, the first end of said cylindrical body member including a cylindrical sleeve having an outer wall of a first predetermined diameter and an inner wall, the inner wall bounding a first central bore extending about said tubular post, the second end of said cylindrical body member engaging said tubular post proximate the second end thereof, said cylindrical sleeve having an open rear end portion for receiving the outer jacket of the coaxial cable, said open rear end portion being deformable; and d. a compression ring having first and second opposing ends and having a central passageway extending therethrough between the first and second ends thereof, the first end of said compression ring having a first internal bore of a diameter commensurate with the first predetermined diameter of the outer wall of said cylindrical sleeve for allowing the first end of said compression ring to extend over the first end of said cylindrical body member, the central passageway of said compression ring including an inwardly tapered annular wall leading from the first internal bore and narrowing to a reduced diameter as compared with the first predetermined diameter, *wherein said compression ring is initially integral with the sleeve of said cylindrical body member and connected thereto by a frangible connection, and wherein axial advancement of said compression ring toward the second end of said cylindrical body member breaks the frangible connection between said compression ring and said cylindrical body member*;

e. said inwardly tapered annular wall causing said rear end portion of said cylindrical sleeve to be deformed inwardly toward said tubular post and against the jacket of the coaxial cable as said compression ring is advanced axially over the cylindrical body member toward the second end of said cylindrical body member, *wherein said rear end portion of said cylindrical sleeve pivots inwardly toward said tubular post*.

6. A connector for coupling the [and] *end* of a coaxial cable to a threaded port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an exposed end of the coaxial cable around the dielectric thereof and under the conductive grounding sheath thereof, said tubular post having an opposing second end;

b. a nut having a first end for rotatably engaging the second end of said tubular post and having an opposing second end with an internally threaded bore for threadedly engaging a threaded port;

c. a cylindrical body member having a first end and a second end, the first end of said cylindrical body member including a cylindrical sleeve having an outer wall of a first predetermined diameter and an inner wall, the inner wall bounding a first central bore extending about said tubular post, the second end of said cylindrical body member engaging said tubular post proximate the second end thereof, said cylindrical sleeve having an open rear end portion for receiving the outer jacket of the coaxial cable, said open rear end portion being deformable; and d. a compression ring having first and second opposing ends and having a central passageway extending therethrough between the first and second ends thereof, the first end of said compression ring having a first internal bore of a diameter commensurate with the first predetermined diameter of the outer wall of said cylindrical sleeve for allowing the first end of said compression ring to extend over the first end of said cylindrical body member, the central passageway of said compression ring including an inwardly tapered annular wall leading from the first internal bore and narrowing to a reduced diameter as compared with the first predetermined diameter;

e. said inwardly tapered annular wall causing said rear end portion of said cylindrical sleeve to be deformed inwardly toward said tubular post and against the jacket of the coaxial cable as said compression ring is advanced axially over the cylindrical body member toward the second end of said cylindrical body member; and f. wherein said cylindrical sleeve of said cylindrical body member has a circular relief formed therein to facilitate bending of said cylindrical sleeve as said compression ring is axially advanced thereover.

*8. The connector recited by claim 1 wherein the first internal bore is non-tapered.*

*9. The connector recited by claim 1 wherein the first internal bore is of constant diameter.*

*10. A connector for coupling the end of a coaxial cable to a threaded port, the coaxial cable having a center conductor surrounded by a dielectric, the dielectric being surrounded by a conductive grounding sheath, and the conductive grounding sheath being surrounded by a protective outer jacket, said connector comprising in combination:*

*a. a tubular post having a first end adapted to be inserted into an exposed end of the coaxial cable around the dielectric thereof and under the conductive grounding sheath thereof, said tubular post having an opposing second end;*

*b. a nut having a first end for rotatably engaging the second end of said tubular post and having an opposing second end with an internally threaded bore for threadedly engaging a threaded port;*

*c. a cylindrical body member having a first end and a second end, the first end of said cylindrical body member including a cylindrical sleeve having an outer wall of a first predetermined diameter and an inner wall, the inner wall bounding a first central bore extending about said tubular post, the second end of said cylindrical body member engaging said tubular post proximate the second end thereof, said cylindrical sleeve having an open rear end portion for receiving the outer jacket of the coaxial cable, said open rear end portion being deformable; and*

*d. a compression ring having first and second opposing ends and having a central passageway extending therethrough between the first and second ends thereof, the first end of said compression ring having a first internal bore of a diameter commensurate with the first predetermined diameter of the outer wall of said cylindrical sleeve for allowing the first end of said compression ring to extend over the first end of said cylindrical body member, the central passageway of said compression ring including an inwardly tapered annular wall leading from the first internal bore and narrowing to a reduced diameter as compared with the first predetermined diameter;*

*e. said inwardly tapered annular wall causing said rear end portion of said cylindrical sleeve to be pivotally deformed inwardly toward said tubular post and against the jacket of the coaxial cable as said compression ring is advanced axially over the cylindrical body member toward the second end of said cylindrical body member; and*

*f. wherein said cylindrical sleeve of said cylindrical body member has a circular relief formed therein to facilitate bending of said cylindrical sleeve as said compression ring is axially advanced thereover, wherein said cylindrical sleeve pivots about the circular relief.*

* * * * *